US007459181B2

(12) United States Patent
Shoda

(10) Patent No.: US 7,459,181 B2
(45) Date of Patent: Dec. 2, 2008

(54) METHOD FOR COATING ADHESIVE AGENT AND APPARATUS FOR COATING THE SAME

(75) Inventor: Kan Shoda, Ota (JP)

(73) Assignee: Shigeru Co., Ltd., Tokyo (JP)

( * ) Notice: Subject to any disclaimer, the term of this patent is extended or adjusted under 35 U.S.C. 154(b) by 246 days.

(21) Appl. No.: 10/924,087

(22) Filed: Aug. 23, 2004

(65) Prior Publication Data

US 2005/0260344 A1 Nov. 24, 2005

(30) Foreign Application Priority Data

May 24, 2004 (JP) ..... 2004-152772

(51) Int. Cl.

| | |
|---|---|
| ***B05D 5/10*** | (2006.01) |
| ***B05D 3/12*** | (2006.01) |
| ***B05D 1/28*** | (2006.01) |
| ***B05C 1/08*** | (2006.01) |

(52) U.S. Cl. ..... 427/207.1; 427/299; 427/428.01; 427/428.18; 427/428.09; 118/225; 118/226

(58) Field of Classification Search ..... 427/428.01, 427/428.07, 428.08, 428.09, 428.18; 118/225, 118/226

See application file for complete search history.

(56) References Cited

U.S. PATENT DOCUMENTS 3,774,250 A * 11/1973 Miller ..... 5/737
4,614,679 A * 9/1986 Farrington et al. ..... 428/138

FOREIGN PATENT DOCUMENTS

| | | |
|---|---|---|
| GB | 1095901 | * 12/1967 |
| JP | 2002-52508 | 2/2002 |
| KR | 2003086498 A | * 11/2003 |

* cited by examiner

*Primary Examiner*—William Phillip Fletcher, III
*Assistant Examiner*—Cachet I Sellman
(74) *Attorney, Agent, or Firm*—Osha · Liang LLP

(57) ABSTRACT

A plate material A composed of a foamed material is compressed by two pairs of compression rolls 1, 1. The plate material A compressed by the compression rolls 1, 1 is passed between a pair of coating rolls 3, 3 while the plate material A is still in its compressed state. An adhesive agent is coated on at least one of upper and lower surfaces of the plate material A by the pair of coating rolls 3, 3.

2 Claims, 2 Drawing Sheets

METHOD FOR COATING ADHESIVE AGENT AND APPARATUS FOR COATING THE SAME

BACKGROUND OF THE INVENTION

This invention relates to a method for coating an adhesive agent to at least one of the opposite surfaces of a plate material composed of a foamed material and a coating apparatus suited for carrying out the coating method.

In the coating method and the coating apparatus of the present invention, a plate material as an object for coating thereon an adhesive agent is a plate material of the type composed of a foamed material having open cells such as a polypropylene foam or a urethane foam, and in which when the compressing force is released after the plate material is widthwise compressed, for example, by $\Delta T$, the plate material is immediately returned to this original state by $\Delta T1$ ($<\Delta T$) of all the compression deformation portion $\Delta T$ but the remaining compression deformation portion $\Delta T2$ ($=\Delta T-\Delta T1$) is gradually returned to its original state taking time, for example, more than a few minutes.

In general, a roof lining material of an automobile comprises a core material, a plate material composed of a urethane foam fixed by bonding to a surface of the core material facing the inside of the automobile, and a skin fixed by bonding to a surface of the plate material facing the inside of the automobile. In manufacturing such lining material, after an adhesive agent is coated to both of the front surface and the back surface of the plate material, the core material and the skin are bonded to the respective surfaces of the plate material.

Conventionally, in coating an adhesive agent to both the front surface and the back surface, a pair of coating rolls are used as disclosed in the official gazette of Japanese Patent Application Laid-Open No. 2002-52508. The pair of coating rolls are vertically spacedly arranged in parallel relation with their longitudinal direction directing in a horizontal direction and driven for rotation in opposite directions to each other. Moreover, an adhesive agent supplied from an adhesive agent supplying apparatus is coated to the entire outer peripheral surface of each coating roll. Accordingly, when a plate material is passed between the pair of coating rolls, the adhesive agent is coated to both the front surface and the back surface.

Since the plate material used as a top lining material of an automobile is large in length and width, the plate material is comparatively greatly different in thickness at its various parts. For this reason, when an adhesive agent is coated to the plate material by the coating rolls, the adhesive agent coated to the various parts of the plate material becomes greatly irregular in thickness. That is, there is a problem that a large quantity of an adhesive agent is coated to the thick part of the plate material, while a small quantity of an adhesive agent is coated to a thin part of the plate material.

SUMMARY OF THE INVENTION

The present invention has been accomplished by paying an attention to a fact that when a compressing force is released after a plate material composed of a foamed material having open cells, such as a urethane foam or a polypropylene foam is compressed, a part of the compression deformation portion is immediately returned to its original state but the remaining compression deformation portion is gradually returned to its original state taking time, for example, more than a few minutes.

According to a first aspect of the present invention which has been accomplished by paying attention to the above-mentioned fact, there is provided a method for coating an adhesive agent comprising compressing a plate material composed of a foamed material in a thicknesswise direction thereof; and coating an adhesive agent to at least one outer peripheral surface of the plate material by passing the plate material between a pair of coating rolls before the compressed plate material is returned to its original thickness, the pair of coating rolls being rotated in opposite directions to each other, the adhesive agent being coated to an outer peripheral surface of at least one of the pair of coating rolls.

According to a second aspect of the present invention, there is provided an apparatus for coating an adhesive agent comprising at least one pair of compression rolls spacedly arranged in parallel relation and driven for rotation in opposite directions to each other, a pair of coating rolls vertically spacedly arranged in parallel relation at a rear stage of the pair of compression rolls with longitudinal direction of the pair of coating rolls directed in a horizontal direction and rotated in opposite directions to each other, and adhesive agent supplying means for supplying to an outer peripheral surface of at least one of the pair of coating rolls, the pair of coating rolls coating an adhesive agent to at least one surface of a plate material composed of a foamed material after the plate material is compressed by the pair of compression rolls.

The pair of compression rolls are preferably arranged in parallel relation with the pair of coating rolls. Preferably, conveying means for conveying the plate material compressed by the compression rolls and inserting the same between the pair of coating rolls is disposed between the pair of compression rolls and the pair of coating rolls.

Plural pairs of the compression rolls are preferably spacedly arranged in a back and forth direction.

DETAILED DESCRIPTION OF THE INVENTION

The best mode for carrying out the present invention will be described hereinafter with reference to the drawings.

Figure 1:
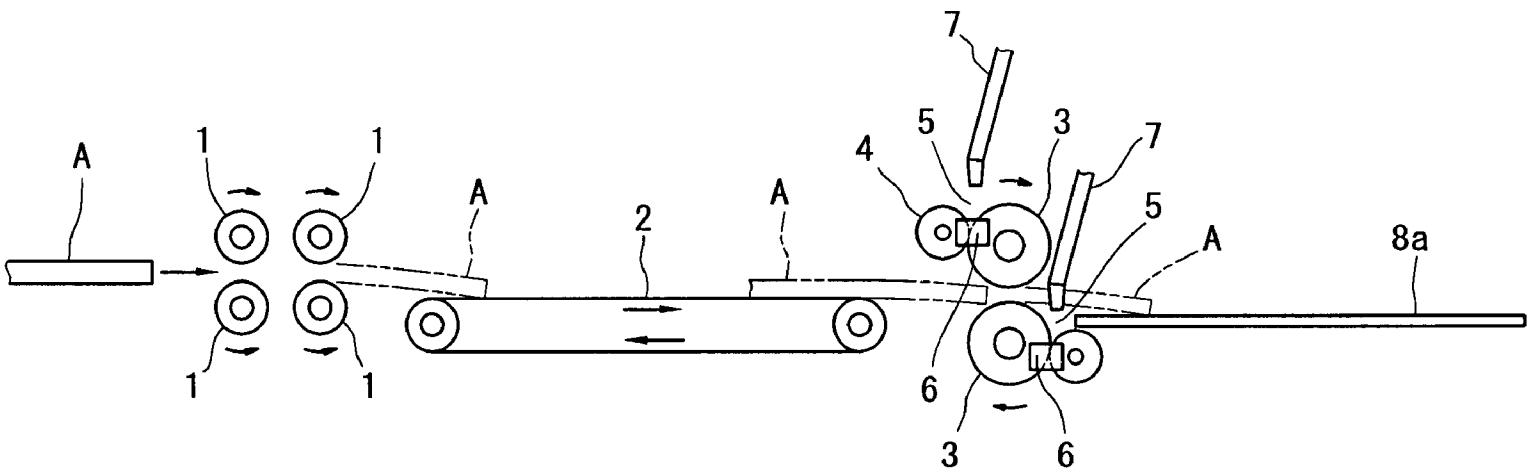
FIG. 1 is a side view showing a general construction of one embodiment of the present invention.
Figure 2:
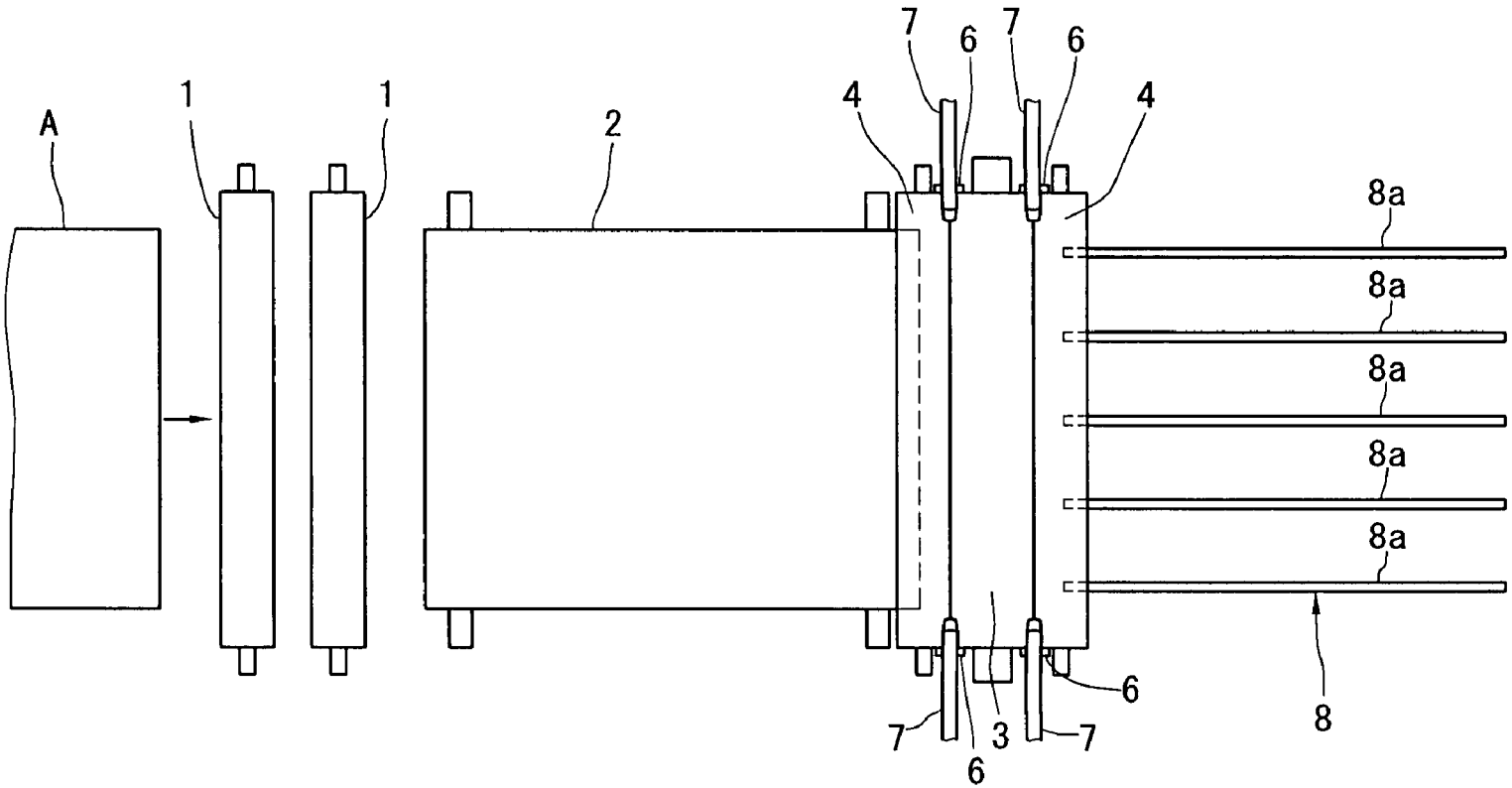
FIG. 2 is a plan view of the above embodiment.

FIGS. 1 and 2 show one embodiment of an apparatus for coating an adhesive agent according to the present invention. The apparatus for coating an adhesive agent according to this embodiment is of the type for coating a liquefied adhesive agent (not shown) having a relatively high viscosity such as isocyanate to both the upper and lower surfaces (both the front and back surfaces) of the planar plate material A. The plate material A is as a foam layer for the top lining material for an automobile and is composed of a foam having open cells such as a polypropylene foam and a urethane foam. The plate material A is formed by slicing a foam block whose configuration in section and dimension are identical with a configuration and a dimension in a plan view of the plate material A.

In the apparatus for coating an adhesive agent according to this embodiment, a frame (not shown) as an apparatus main body is installed on a floor. This frame is provided with two pairs of compression rolls 1, 1, a belt conveyor (conveying means) 2, and a pair of coating rolls 3, 3 in order from its front stage side to its rear stage side (from the left side to the right side in FIGS. 1 and 2). After compressed by the compression rolls 1, 1, the plate material A which is to be coated with an adhesive agent is immediately inserted between the pair of coating rolls 3, 3 by the belt conveyor, so that an adhesive agent is coated to both the upper and lower surfaces (front and back surfaces) of the plate material A. The two pairs of compression rolls 1, 1, the belt conveyor 2 and the coating rolls 3, 3 may be individually installed on a floor instead of being installed on a single frame.

The two pairs of compression rolls 1, 1 are adapted to reduce the thickness of the plate material A by compressing it. The first pair of compression rolls 1, 1 and the second pair of compression rolls 1, 1 are slightly spacedly arranged in the back and forth direction in the moving direction of the plate material A. Of course, a separation distance between the first pair of compression rolls 1, 1 and the second pair of compression rolls 1, 1 is set significantly shorter than the length of the plate material A. One pair or three pairs or more of the compression rolls 1, 1 may be provided instead of two. The reason why the two pairs of compression rolls 1, 1 are provided is to more surely compress the plate material A.

The length of the first (front stage) pair of compression rolls 1, 1 is set longer than the width of the plate material A, so that the plate material A can be compressed. Moreover, the compression rolls 1, 1 are vertically spacedly arranged in parallel relation with their longitudinal direction directed in a horizontal direction. A vertical interval between the outer peripheral surfaces of the compression rolls 1, 1 is set smaller by a predetermined amount than a nominal thickness of the plate material A. This vertical interval is set, through experiments, by taking into consideration the thickness of the plate material A, irregularities in thickness of the plate material A at various parts of the plate material A, and an amount required for the compressed plate material A to return to its original state until the time the plate material A is inserted between the coating rolls 3, 3. Normally, the vertical interval between the compression rolls 1, 1 is set generally equal to the thickness of the thinnest part, of all the thicknesses of the various parts, of the plate material A. That is, the vertical interval between the compression rolls 1, 1 is set to generally equal to the thickness of the thinnest part of the plate material A. The thinnest part of this particular plate material A is thinner than the thinnest part of any other plate material A. The compression rolls 1, 1 are rotated in opposite directions to each other at a same speed by a rotation driving source (not shown) such as a motor. Accordingly, when the plate material A is inserted between the compression rolls 1, 1, the plate material A is taken into between the compression rolls 1, 1 so as to move toward the rear stage side and compressed by the compression rolls 1, 1.

The second (rear stage) pair of compression rolls 1, 1 are constructed in the same manner as the first pair of compression rolls 1, 1 and the second pair of compression rolls 1, 1 and arranged in the same positional relation with the first compression rolls 1, 1, only excepting that the second pair of compression rolls 1, 1 are arranged at the rear stage of the first pair of compression rolls 1, 1. Accordingly, the interval between the outer peripheral surfaces of the second compression rolls 1, 1 is same as the interval between the outer peripheral surfaces of the first compression rolls 1, 1. However, the interval between the second compression rolls 1, 1 may be slightly smaller than the interval between the first compression rolls 1, 1. Here again, the respective intervals between the front state rolls 1, 1 and between the rear stage rolls 1, 1 are set, through experiments, by taking into consideration the thickness of the plate material A, irregularities in thickness of the plate material A at various parts of the plate material A, and an amount required for the compressed plate material A, which has passed between the rear stage compression rolls 1, 1, to return to its original state until the time the plate material A is inserted between the coating rolls 3, 3. The second pair of compression rolls 1, 1 are driven for rotation at a same speed as the first pair of compression rolls 1, 1. Accordingly, the plate material A, which has passed between the first pair of compression rolls 1, 1, is smoothly inserted between the second pair of compression rolls 1, 1, and is simultaneously compressed by the first and second pairs of compression rolls 1, 1; 1, 1. At that time, since the first and second pairs of compression rolls 1, 1; 1, 1 are driven for rotation at a same speed, no tensile force nor compressive force acts on the plate material A located between the first pair of compression rolls 1, 1 and the second pair of compression rolls 1, 1.

The belt conveyor 2 is adapted to carry the plate material A compressed by the compression rolls 1, 1 and convey the same toward the rear stage side so as to be inserted between the coating rolls 3, 3. The belt conveyor 2 is arranged such that an upper surface thereof is horizontal. Moreover, the upper surface of the belt conveyor 2 is arranged in such a manner as to be located at a lower side than a lower end of a gap formed between the pair of compression rolls 1, 1, so that a forward end part of the plate material A will be smoothly received even if the forward end part of the plate material A, which has passed between the rear stage side compression rolls 1, 1, is deformed downward by its dead weight. The length and the width of the upper surface of the belt conveyor 2 are set in such a manner as to be able to carry the plate material A, which has passed between the rear state side compression rolls 1, 1, in a horizontal posture. The conveying speed of the belt conveyor 2 is set equal to the rotation speed at the outer peripheral surfaces of the compression rolls 1, 1 so that the plate material A delivered from the compression rolls 1, 1 can be smoothly carried on the upper surface of the belt conveyor 2. However, even if there should be slight difference in speed therebetween, no tensile force nor pressing force would act on the plate material A because the plate material A carried on the belt conveyor 2 would slide on the upper surface of the belt conveyor 2 by a portion equal to the speed difference. Instead of the belt conveyor 2, a roller conveyor may be used.

The pair of coating rolls 3, 3 are adapted to coat an adhesive agent to both the upper and lower surfaces of the plate material A compressed by the compression rollers 1, 1. Therefore, the length of the pair of coating rolls 3, 3 is set to be longer than the width of the plate material A. Moreover, the pair of coating rolls 3, 3 are mutually vertically spacedly arranged. The interval between the two outer peripheral surfaces of the pair of coating rolls 3, 3 is set to be larger, by a prescribed dimension, than the thickness of the plate material A immediately before it is inserted between the coating rolls 3, 3. This interval is properly determined, through experiments, in accordance with the thickness of the plate material A and the thickness of the adhesive agent which is to be coated to both the upper and lower surfaces. The pair of coating rolls 3, 3 are arranged such that a lower end of the interval between the coating rolls 3, 3 is located at a lightly lower side than the upper surface of the belt conveyor 2 so that when the forward end part projecting from the belt conveyor 2 of the plate material A is deformed by its dead weight, the forward end part of the plate material A can smoothly enter between the coating rolls 3, 3. The pair of coating rolls 3, 3 thus arranged and constructed are driven for rotation in opposite directions to each other at a same speed by a rotation driving source (not shown). Moreover, the coating rolls 3, 3 are set such that the peripheral speed at their outer peripheral surfaces is equal to the conveying speed of the belt conveyor 2. Accordingly, the plate material A conveyed by the belt conveyor 2 is smoothly inserted between the coating rolls 3, 3. Of course, as in the case with the compression rolls 1, 1 and the belt conveyor 2, even if there is difference in speed between the conveying speed of the belt conveyor 2 and the peripheral speed of the coating rolls 3, 3, this speed difference can be absorbed the plate material A sliding on the upper surface of the belt conveyor 2. Although the interval between the coating rolls 3, 3 is larger than the thickness of the plate material A, the adhesive agent adhered to the outer peripheral surfaces of the coating rolls 3, 3 serves to bond the plate material A to the coating rolls 3, 3 and therefore, the plate material A is moved forward (rightward in FIG. 1) in accordance with the rotation of the coating rolls 3, 3.

An auxiliary roll 4 is disposed at a front stage side (left side in FIG. 1) of the upper coating roll 3. The auxiliary roll 4 is disposed in parallel relation with and generally at a same height as the coating roll 3. Moreover, the auxiliary roll 4 is rotatably disposed at a frame with its outer peripheral surface generally contacted with the outer peripheral surface of the coating roll 3. As a consequence, an adhesive agent pool 5 having a generally triangular shape in section and extending from one end of the coating roll 3 to the other end is formed between the adjacent parts of the outer peripheral surfaces of the auxiliary roll 4 and the coating roll 3. The opposite end parts of the adhesive agent pool 5 in the axial direction of the coating roll 3 are closed with a weir plate 6 relatively slideable with the respective end faces of the coating roll 3 and the auxiliary roll 4. Accordingly, when a liquefied adhesive agent (not shown) having a high viscosity is supplied to the adhesive agent pool 5 from an adhesive agent supplying source (not shown) through a supplying tube 7, the adhesive agent is pooled in the adhesive agent pool 5. Then, the adhesive agent pooled in the adhesive agent pool 5 is adhered to the entire peripheral surface of the coating roll 3 in accordance with the rotation of the coating roll 3. Another auxiliary roll 4 is also disposed at a rear stage side of the lower stage coating roll 3, and an adhesive agent pool 5 is formed by their outer peripheral surfaces and the weir plate 6. The adhesive agent is supplied to this adhesive agent pool 5 through a supplying tube 7. The adhesive agent pooled in the adhesive agent pool 5 is coated to the entire peripheral surface of the coating roll 3 in accordance with the rotation of the coating roll 3. As apparent from this, the adhesive supplying means is constituted by the auxiliary roll 4, the weir plate 6, the adhesive agent source and the supplying tube 7.

A supporting part 8 is disposed at a rear stage of the pair of coating rolls 3, 3. This supporting part 8 consists of a plurality of rod materials 8*a* horizontally extending along the moving direction of the plate material A. The respective rod materials 8*a* are arranged on a plane which is located at a slightly lower side than the lower end of the gap between the coating rolls 3, 3. Owing to this arrangement, the forward end part of the plate material A which has passed between the coating rolls 3, 3 can surely be placed on the supporting part 8. The plate material A placed on the supporting part 8 is slid on the respective rod materials 8*a*. After passing between the coating rolls 3, 3, the plate material A is horizontally carried on the supporting part 8.

In case the adhesive agent is to be coated on both the front and back surfaces of the plate material A by the adhesive agent coating apparatus having the above-mentioned construction, first, the plate material A is inserted between the first pair of compression rolls 1, 1 from their front side. Then, the plate material A is compressed by the first pair of compression rolls 1, 1 and also by the second pair of compression rolls 1, 1 which are arranged at the rear stage of the first pair of compression rolls 1, 1. The plate material A is greatly compressed by the compression rolls 1, 1 at its thick part and slightly compressed at its thin part. A part of the compression deformed part of the compressed plate material A is immediately returned to its original state and the remaining part merely maintains its compressed state. An amount of compressive deformation maintaining the compressed state is large at the greatly compressed part and small at the slightly compressed part. Accordingly, irregularities of the thickness at various parts of the plate material A can be reduced.

The compressed plate material A is carried on the belt conveyor 2 and conveyed toward the coating rolls 3, 3 side. The compressed plate material A is then inserted between the coating rolls 3, 3. The plate material A inserted between the coating rolls 3, 3 is progressed therebetween in accordance with the rotation of the coating rolls 3, 3. At that time, the adhesive agent is coated to both the upper and lower surfaces of the plate material A by the coating rolls 3, 3. An amount of the adhesive agent coated on both the upper and lower surfaces of the plate material A is irregular in accordance with irregularity in thickness at the various parts of the plate material A. However, as mentioned above, since the plate material A is compressed between the compression rolls 1, 1, irregularity in thickness at the various parts of the plate material A becomes small and therefore, the irregularity of the amount of the adhesive agent coated to both the upper and lower surfaces of the plate material A can be reduced.

It should be noted here that the present invention is not limited to the above-mentioned embodiment and that many changes and modifications can be made in accordance with necessity without departing from the gist of the invention.

For example, in the above-mentioned embodiment, although the plate material A is compressed between the pair of compression rolls 1, 1, the plate material A may be compressed by a pressing apparatus at the time for carrying out the method for coating an adhesive agent according to the present invention.

Moreover, in the above-mentioned embodiment, although an adhesive agent is coated to both the upper and lower surfaces of the plate material A the agent may be coated to either the upper or the lower surface. In that case, an adhesive agent may be coated to only one of the pair of coating rolls 3, 3.

What is claimed is:

1. A method for coating an adhesive agent comprising:

compressing a plate material composed of a foamed material in a thicknesswise direction thereof; and coating an adhesive agent to at least one outer peripheral surface of said plate material by passing said plate material between a pair of coating rolls at a time after the compression and before said compressed plate material is returned to its original thickness, said pair of coating rolls being rotated in opposite directions to each other, said adhesive agent being directly coated to an outer peripheral surface of at least one of said pair of coating rolls without any other material therebetween.

2. A method for coating an adhesive agent according to claim 1, wherein said plate material is compressed by at least a pair of compression rolls spatially arranged in parallel relation and driven for rotation in opposite directions to each other.

* * * * *